US006607341B1

(12) United States Patent
Wade

(10) Patent No.: US 6,607,341 B1
(45) Date of Patent: Aug. 19, 2003

(54) CABINET INSTALLATION APPARATUS AND ASSOCIATED METHODS

(76) Inventor: Robert A. Wade, 1932 Hawken Dr., Plano, TX (US) 75023

( * ) Notice: Subject to any disclaimer, the term of this patent is extended or adjusted under 35 U.S.C. 154(b) by 0 days.

(21) Appl. No.: 10/090,949

(22) Filed: Mar. 5, 2002

(51) Int. Cl.[7] ..... B66B 9/16
(52) U.S. Cl. ..... 414/10; 187/267; 414/800
(58) Field of Search ..... 414/10, 800; 187/267, 187/268; 254/89 R, 90, 92, 102, DIG. 2

(56) References Cited

U.S. PATENT DOCUMENTS

| | | | | | |
|---|---|---|---|---|---|
| 178,390 | A | * | 6/1876 | Taylor | 254/85 |
| 450,570 | A | * | 4/1891 | Hammer | 254/95 |
| 758,431 | A | * | 4/1904 | Edeline | 254/1 |
| 2,140,617 | A | * | 12/1938 | Castady | 182/141 |
| 3,074,693 | A | * | 1/1963 | Shumake | 254/92 |
| 3,464,670 | A | * | 9/1969 | Rasmussen | 254/92 |
| 3,881,692 | A | * | 5/1975 | Clarke | 254/101 |
| 4,128,234 | A | | 12/1978 | McKee | 269/97 |
| 4,340,205 | A | | 7/1982 | Leezer | 254/98 |
| 4,715,760 | A | | 12/1987 | Browning | 414/10 |
| 4,955,592 | A | | 9/1990 | Brennan, Sr. | 269/68 |
| 4,981,288 | A | | 1/1991 | Goss | 269/79 |
| 5,169,219 | A | | 12/1992 | Obbink | 312/245 |
| 5,593,137 | A | * | 1/1997 | Johnson | 254/122 |
| 5,609,332 | A | | 3/1997 | Hassell | 269/16 |
| 5,645,272 | A | | 7/1997 | Brennan, Sr. | 269/68 |
| 6,238,159 | B1 | | 5/2001 | Pappas | 414/10 |
| 6,253,878 | B1 | * | 7/2001 | Wells | 187/268 |
| 6,322,062 | B1 | | 11/2001 | Conn et al. | 269/20 |

* cited by examiner

*Primary Examiner*—Janice L. Krizek
(74) *Attorney, Agent, or Firm*—Konneker & Smith, P.C.

(57) ABSTRACT

Apparatus for facilitating the installation of a modular cabinet assembly on a wall includes two adjustable height lifting and leveling assemblies each having a base portion positionable on the floor. An upper portion of each assembly has spaced structures useable for receiving sections of two elongated, horizontally spaced apart support members which extend parallel to one another and to the wall. With the assemblies in a horizontally spaced relationship with one another and secured to the wall, and a plurality of cabinet modules resting on top side portions of the support members, the modules are secured to one another, and the resulting assembly is leveled about axes perpendicular and parallel to the wall by using leveling portions of the assemblies to vary the heights of the support member sections disposed in the receiving sections. The leveled cabinet assembly is then anchored to the wall.

19 Claims, 3 Drawing Sheets

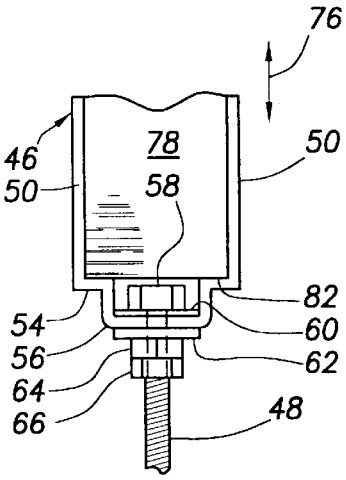
FIG.4
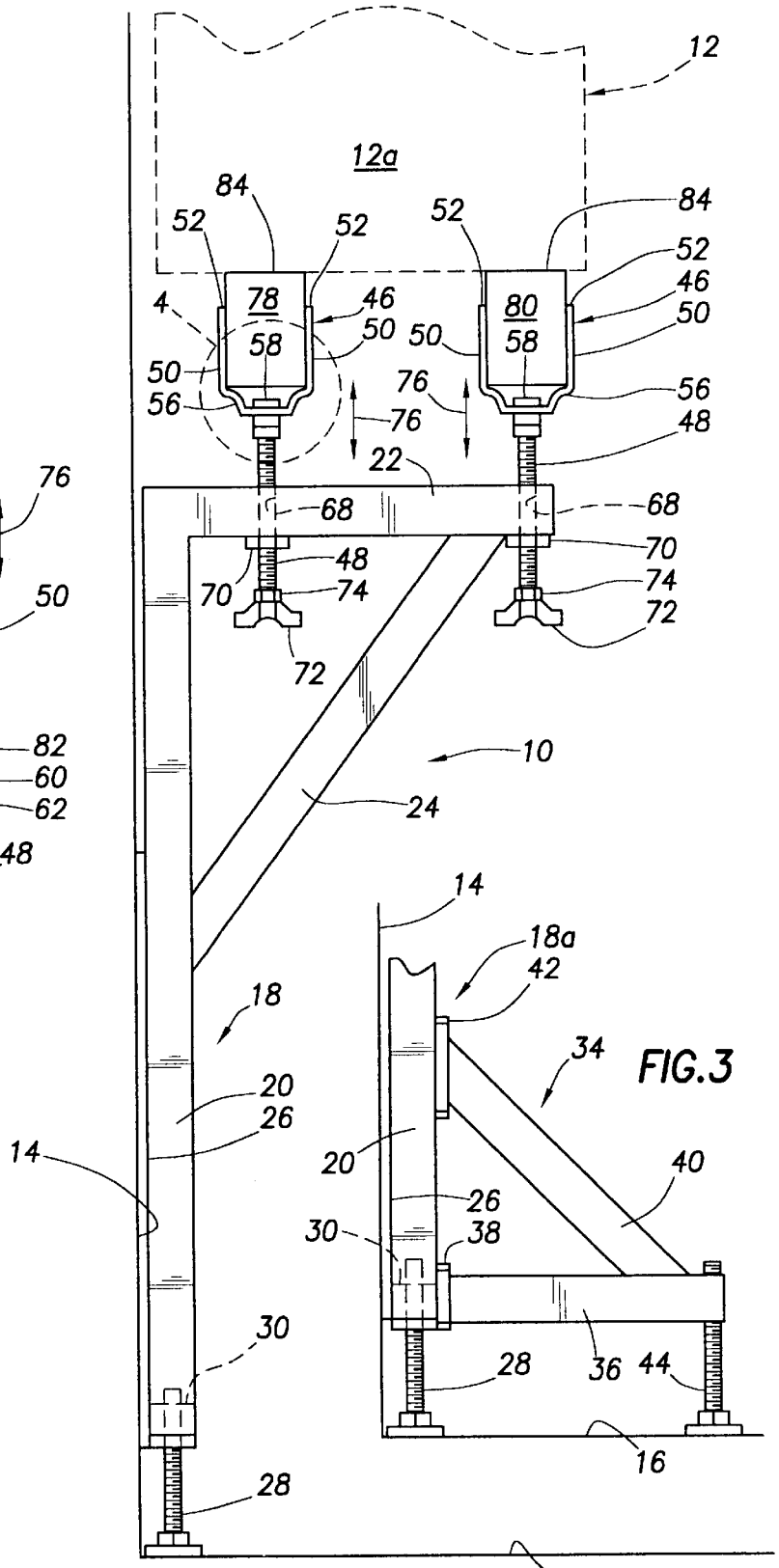
FIG.3
FIG.2

CABINET INSTALLATION APPARATUS AND ASSOCIATED METHODS

BACKGROUND OF THE INVENTION

The present invention generally relates to the installation of cabinets and, in a preferred embodiment thereof, more particularly relates to specially designed apparatus, and associated methods, for installing wall-mounted cabinets such as, for example, kitchen cabinets.

Wall mounted cabinets, such as kitchen cabinets, are typically manufactured in modules which may be secured together in a side-by-side relationship and anchored to a wall, normally above floor-mounted base cabinets. As is well known in the construction industry, the installation of wall-mounted kitchen cabinets is typically a surprisingly difficult and awkward task often requiring at least two people to support, align and secure the elevated cabinet modules to one another and to the wall.

In the past, various structures have been proposed to make this cabinet installation task easier, less time-consuming and more accurate from the standpoint of properly aligning the cabinet modules with one another and leveling the resulting cabinet module assembly with respect to both the wall and the floor. For example, various telescoping jack devices have been proposed to lift the cabinet modules one at a time to their installation levels on the wall. While this technique permits a single installer to lift a module to its installation height and hold the module at such height, the typical jack device tends to be rather tippy, and can result in the module, when secured to the wall, being tilted vertically and/or horizontally if the jack device is not plumb when the module is secured to the wall.

Other types of previously proposed jack devices are operative to underlie a central portion of a previously constructed modular cabinet assembly (in which several cabinet modules have previously been secured to one another) and lift the assembly to its installation height on a wall. Unfortunately, the use of this previously proposed jack assembly often results in the lifted cabinet module assembly "drooping" at its opposite ends when lifted to its installation height, thereby making it difficult to install the lifted assembly in the desired horizontally level orientation. Also, this type of jack device does not provide for easy prevention of undesirable vertical (i.e., front-to-rear) tilting of the lifted assembly.

A somewhat easier previously proposed method of installing a modular cabinet assembly in an elevated position on a wall is to first nail a horizontally oriented wooden stud on the wall and then support the cabinet modules on the stud before leveling them, intersecuring them, and anchoring the resulting modular assembly to the wall. This construction method unfortunately requires at least two workman to support the modules on the top side of the stud while the rest of the installation procedure is being carried out. Additionally, such method does not easily provide for front side alignment of the modules with one another, and leaves visible holes in the wall (from nails temporarily securing the stud to the wall) when the stud is subsequently removed.

As can readily be seen from the foregoing, a need exists for improved apparatus and methods for installing wall-mounted modular cabinet assemblies. It is to this need that the present invention is primarily directed.

SUMMARY OF THE INVENTION

In carrying out principles of the present invention, in accordance with a preferred embodiment thereof, specially designed lifting and leveling apparatus is provided for use in installing a cabinet structure on an elevated area of a wall. The apparatus includes an elongated support structure upon a top side surface portion of which the cabinet structure may be rested; first and second base structures positionable in a horizontally spaced relationship beneath the elevated wall area and having upper portions operative to hold longitudinally spaced apart portions of it the elongated support structure in a manner positioning the support structure parallel to the wall and in a horizontal orientation; and height adjustment structures associated with the upper portions of the first and second base structures for vertical movement relative thereto and being operative, when the support structure is held by the upper portions of the first and second base structures, to (1) raise and lower the support structure, (2) tilt the support structure top side surface portion about a horizontal axis transverse to the wall, and (3) tilt the support structure top side surface portion about a horizontal axis parallel to the wall.

Preferably, the elongated support structure is defined by a pair of elongated wooden studs, and the base structures include generally inverted L-shaped frames with vertically orientable side portions and top end portions extending perpendicularly to the side portion, the top end portion having a top side upon which spaced pairs of receiving members, representatively generally U-shaped cradle structures, are supported for vertical movement relative thereto. Each cradle structure is adapted to downwardly receive a longitudinal portion of one of the support studs, thereby positioning the two studs in a horizontally offset, parallel relationship in which the studs extend parallel to the wall. The height adjustment structures, representatively elongated threaded members carried by the frame top end portions, are rotatable to selectively raise or lower an associated one of the cradle structures and thus the stud portion received thereby.

Alternatively, the receiving structures are spaced pairs of fixed projections extending upwardly from the top frame end portions and between which the longitudinal stud portions are receivable. The height adjustment structures in this alternate version of the lifting and leveling apparatus are elongated threaded members carried by the top frame end portions and rotatable relative thereto to enter variable vertical distances between the fixed projection pairs and thus engage and adjustably raise or lower the stud portions received between the fixed projection pairs.

According to other structural features of the invention, the lower ends of the vertically orientable frame side portions are provided with threaded height adjustment members to selectively elevate the frames above the floor. Preferably the vertical frame portions are securable to the wall below the cabinet installation area, and may be provided with outwardly projecting stabilizing feet structure.

In carrying out an installation method of the invention, in a preferred embodiment thereof, a plurality of cabinet modules are rested on top of the horizontally oriented studs, appropriately aligned with one another, and then intersecured to form a cabinet assembly. The height adjustment apparatus is then used to adjust the heights of the support studs in a manner leveling the cabinet assembly about first and second horizontal axes respectively transverse and parallel to the wall to thereby level the supported cabinet assembly in a side-to-side manner, and also "plumb" the cabinet assembly in a front-to-back manner. Additionally, the height adjustment apparatus may also be used to simply raise or lower the cabinet assembly.

The leveled and plumbed cabinet assembly is then simply secured in an appropriate manner to the adjacent wall area, and the lifting and leveling apparatus is removed from beneath the now installed modular cabinet assembly.

BRIEF DESCRIPTION OF THE DRAWINGS

FIG. 2 is a side elevational view of the lifting and leveling assemblies taken generally along line 2—2 of FIG. 1;

FIG. 3 is a simplified side elevational view of an alternate embodiment of a bottom end portion of one of the lifting and leveling assemblies;

FIG. 4 is an enlarged scale detail view of the circled area "4" in FIG. 2;

DETAILED DESCRIPTION

Figure 1:
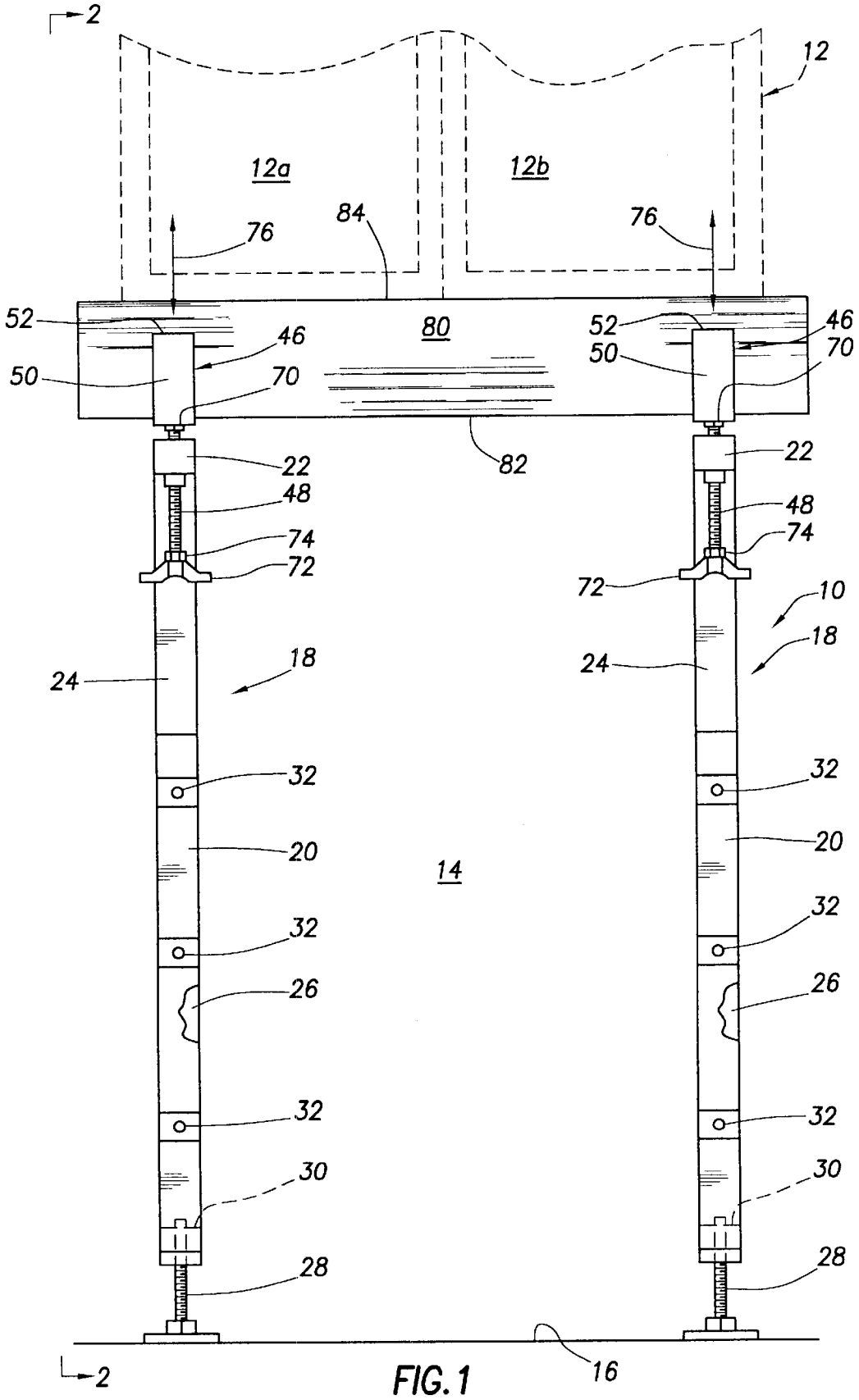
FIG. 1 is a simplified front side elevational view of a pair of specially designed lifting and leveling assemblies which embody principles of the present invention and are shown being used to install a modular cabinet assembly in an elevated position on a wall.

Referring initially to FIGS. 1 and 2, the present invention provides specially designed apparatus 10 used to substantially facilitate and simplify the installation of a modular cabinet assembly 12, partially shown in phantom, on an elevated area of a wall 14 above a floor 16 on which base cabinets (not shown) may subsequently be installed. The cabinet assembly 12 representatively comprises two cabinet modules 12*a*, 12*b* which are illustratively kitchen cabinet modules. However, principles of the present invention are also advantageously applicable to other types of cabinet structures. Additionally, while two cabinet modules are shown for purposes of illustration, it will be readily appreciated by those of ordinary skill in the cabinet installation art that the assembly 12 may comprise more than two cabinet modules. Moreover, as will also be appreciated in light of the subsequent description herein of the apparatus 10, the apparatus 10 may also be advantageously utilized in instances in which only a single cabinet module is to be installed on the wall 14.

Apparatus 10 includes two lifting and leveling assemblies 18 each including a generally inverted L-shaped base or frame portion illustratively formed from a metal square tube material and having a vertical side portion 20, a horizontal top end portion 22, and a slanted cross-bracing portion 24 extending as shown between the horizontal top end portion 22 and an upper section of the vertical side portion 20. For purposes later described herein, a vertically elongated protective wood strip 26 is suitably secured to approximately the lower half of the outer side of the vertical frame portion 20.

At the lower end of each of the vertical frame portions 20 is an elevator bolt 28 which is threaded upwardly into a hard plastic insert member 30 press-fitted into the open lower end of the vertical side portion 20. TO ready the lifting and leveling assemblies 18 for use, the elevator bolts 28 are adjusted so that-they downwardly protrude from the bottom ends of their associated vertical frame side portions 20, and the vertical side frame portions 20 are positioned in a horizontally spaced, vertical orientation beneath the wall location on which the cabinet assembly 12 is to be installed, with the wood strips 26 against the wall 14 (see FIG. 1) and are then temporarily secured to the wall 14 by suitable screws 32 extended through the vertical frame portions 20 and threaded into wall studs (not shown) behind the wall 14. AS best illustrated in FIG. 2, the wood strips 26 space the vertical frame portions 20 slightly outwardly from the wall 14 to thereby prevent the assembly frames from marring the wall. With the vertical frame portions 20 secured to the wall 14 in this manner, the horizontal frame portions 22 project perpendicularly outwardly from the wall 14.

A lower end portion of an alternate embodiment 18*a* of one of the lifting and leveling assemblies 18 is illustrated in FIG. 3. In this alternate embodiment a pair of stabilizing foot structures 34 (only one of which is visible in FIG. 3) are secured to a lower end portion of each vertical frame side portion 20, each foot structure 34 comprising a horizontal frame segment 36 pivotally secured to the lower end of the vertical frame portion 20, as at 38, and a diagonal bracing frame segment 40 extending between the frame segments 20,36 and pivotally secured to the frame segment 20 as at 42. When the foot structures 34 in each pair thereof are horizontally swung outwardly apart from one another, a tripod-like base is formed at the lower end of their associated lifting and leveling assembly 18. A rotatable elevator bolt 44 is threaded upwardly through an outer end portion of each of the pivotally supported horizontal frame segments 36. As can be seen in FIG. 3, the use of these foot structure 34 stabilizes the lifting and leveling assemblies 18 against clockwise torque imposed thereon when the assemblies 18 underlie and temporarily support the cabinet assembly 12 as later described herein, and further permits each lifting and leveling assembly 18 to be utilized without securing it to the wall 14.

With reference now to FIGS. 1, 2 and 4, A pair of receiving structures, representatively in the form of generally U-shaped metal lifting and leveling cradles 46, are supported above each of the horizontal top frame portions 22, in a spaced apart relationship along its length, by a pair of vertically oriented height adjustment bolts 48. Each cradle 46 has a spaced apart pair of parallel vertical side plates 50 with vertically aligned upper ends 52, and a bottom side wall 54 extending between the lower ends of the side plates 50 and having a downwardly depressed central portion 56.

The bolt 48 at each cradle 46 has a head portion 58 rotatably disposed within the depressed cradle portion 56, with the threaded body of the bolt 48 extending downwardly from the head 58 sequentially through an upper annular washer 60 resting on the top side of the depressed cradle portion 56, a hole in the bottom side of the depressed cradle portion 56, a lower annular washer 62 on the bottom side of the depressed cradle portion 56, a pair of lock nuts 64,66 threaded onto the bolt body, a vertical hole 68 in the horizontal frame portion 22, and a stationary nut 70 threadingly receiving the bolt body and welded onto the lower side of the horizontal frame portion 22. The lower end of the threaded body of the bolt 48 is threaded into a wing nut 72 disposed beneath the stationary nut 70 and locked to the bolt body by a lock nut 74.

Rotation of a given wing nut 72 correspondingly raises or lowers its associated cradle 46 relative to the horizontal frame portion 22 on which it supported, as indicated by the double-ended arrows 76 in FIGS. 1 and 2. AS illustrated in FIGS. 1 and 2, the two inner cradles 46 (i.e., the two cradles 46 closest to the wall 14) are configured to complementarily receive spaced apart longitudinal portions of a first elongated support member which is representatively a wooden stud 78, or another type of suitable elongated support member such as a metal stud, etc., and the two outer cradles 46 (i.e., the two cradles 46 furthest from the wall 14) are configured to complementarily receive spaced apart longitudinal portions of a second elongated support member which is also representatively a wooden stud 80, but could alternatively be another type of suitable elongated support member such as a metal stud, etc.

With the lifting and leveling assemblies 18 secured to the wall 14 as previously described and illustrated in FIGS. 1 and 2, and the studs 78,80 received in the cradles 46, the studs 78,80 are substantially parallel to one another and to the floor 16 and are horizontally spaced apart from one another in a direction transverse to the wall 14. Bottom side edge surfaces 82 of the studs 78,80 rest on the top sides of the bottom side walls 54 of their associated cradles 46, above the rotatable bolt heads 58, and top side edge surfaces 84 of the studs 78 are disposed above the top ends 52 of the vertical side plates 50 of their associated cradles 46.

The two studs 78,80 combinatively define an elongated support structure removably mountable on the lifting and leveling assemblies 18, with the top stud surfaces 84 combinatively defining a height adjustable and tiltable top side support surface area upon which the cabinet modules 12*a*, 12*b* may be rested in conjunction with a unique wall cabinet installation method which will now be described with reference to FIG. 5.

After the lifting and leveling assemblies 18 have been operatively secured to the wall 14 as previously described herein, with the elevator bolts 28 suitably adjusted to place the horizontal frame sections 22 generally at a preselected work height, the studs 78,80 are operatively positioned in the cradles 46 as shown in FIGS. 1 and 2. The thumb screws 72 are then appropriately rotated to place the top side edge surfaces 84 of the studs 78,80 in a generally horizontal and coplanar orientation.

The as yet unattached cabinet modules 12*a*, 12*b* are then rested atop the stud top side edge surfaces 84, slightly out from the wall. 14 as shown in FIGS. 1 and 2. The loose cabinet modules 12*a*, 12*b* are then adjusted on the stud surfaces 84 in a manner such that the front sides of the modules 12*a*, 12*b* are flush with one another, and the top and bottom sides of the modules 12*a*, 12*b* are aligned with one another (this may require the use of shims placed between the studs and the bottoms of the modules 12*a*, 12*b*). The aligned cabinet modules 12*a*, 12*b* are then suitably secured to one another to form the cabinet assembly 12.

It should be noted at this point in the overall wall cabinet installation process that only a single workman is required to place the cabinet modules atop the studs 78,80 and to align and intersecure the cabinet modules 12*a*, 12*b*. Additional workman are not required to support the modules 12*a*, 12*b* adjacent their ultimate installation area on the wall 14 while the various installation steps are being carried out. Moreover, due to the fact that the studs 78,80 combinatively define an elongated support surface 84,84 for the cabinet assembly 12, the cabinet assembly 12 does not sag in an end-to-end fashion.

After the assembly 12 is completed atop the studs 78,80 a unique feature of the lifting and leveling assemblies 18 is brought into play namely, their ability to adjust the cabinet assembly 12 so that it is horizontally level and vertically plumb before the cabinet assembly 12 is secured in place on the wall 14 and the overall apparatus 10 is removed from the wall 14 to permit the installation of base cabinets (not) shown) beneath the installed wall cabinet assembly 12.

Figure 5:
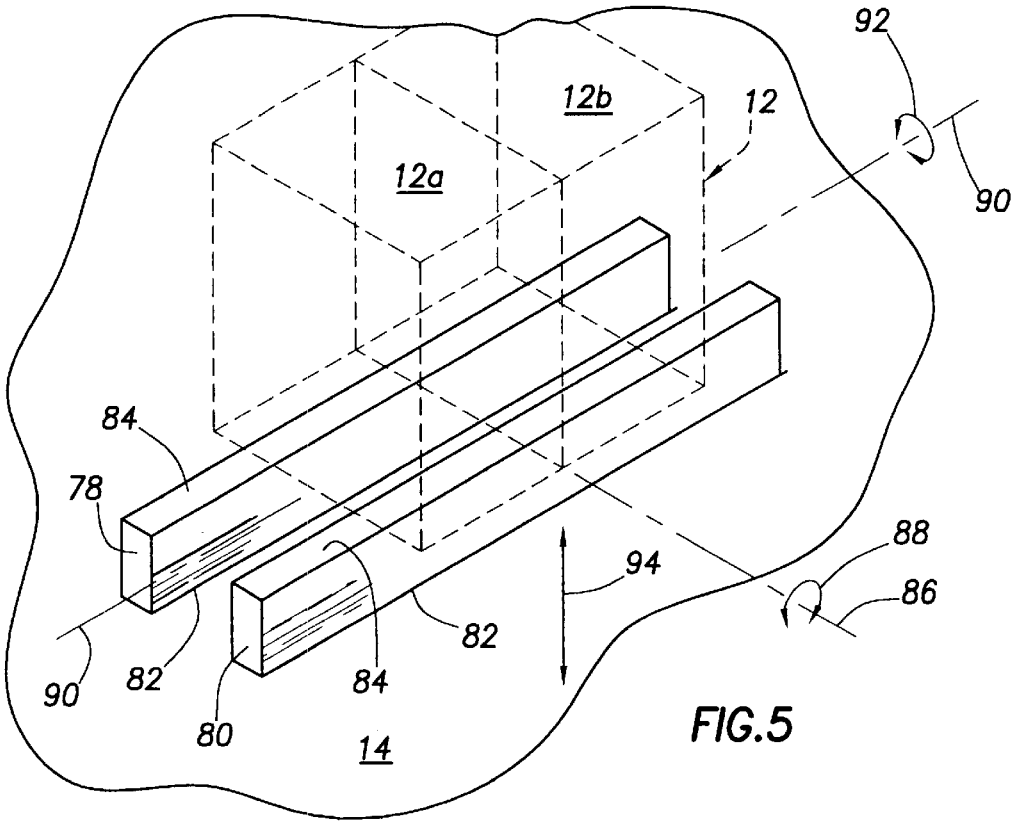
FIG. 5 is a schematic perspective view of a pair of elongated support members used in conjunction with the lifting and leveling assemblies, and illustrates the unique manner in which the assemblies may be used to level the cabinet assembly about horizontal axes perpendicular and parallel to the wall on which the cabinet assembly is to be secured.

Specifically, as schematically shown in FIG. 5, the lifting and leveling assemblies 18 may be conveniently utilized to (1) horizontally level the cabinet assembly 12 by tilting the top side surface area 84,84 of the overall support structure defined by the studs 78,80 about a horizontal leveling axis 86 extending perpendicularly to the wall 14, as indicated by the double-ended arrow 88 in FIG. 5, thereby correspondingly tilting the cabinet assembly 12 about the axis 86, and (2) vertically "plumb" the cabinet assembly 12 by vertically offsetting the top side surfaces 84,84 of the studs 78,80 with respect to one another, thereby tilting the top side surface area 84,84 about a horizontal plumb axis 90 extending parallel to the wall 14, as indicated by the double-ended arrow 92 shown in FIG. 5, and correspondingly tilting the cabinet assembly 12 about the axis 90.

The leveling rotation of the cabinet assembly 12 about the leveling axis 86 may be effected by operating the thumb screws 72 to elevate the cradles 46 on one of the lifting and leveling assemblies 18 relative to the cradles 46 on the other lifting and leveling assembly 18 to tilt the cabinet assembly 12 in the desired direction about the axis 86. The plumbing rotation of the cabinet assembly 12 about the axis 90 may be effected by operating the thumb screws 72 in a manner such that the two cradles 46 at the outer ends of the horizontal frame portions 22 are higher or lower than the two cradles 46 at the inner ends of the horizontal frame portions 22 (i.e., the ends of the frame portions 22 closest to the wall 14) as necessary to tilt the cabinet assembly 12 in the desired direction about the axis 90.

AS can be seen in FIG. 2, this ability to adjustingly tilt the cabinet assembly 12 about the axis 90 is provided by the unique capability of independently adjusting the heights of the two cradles 46 associated with each of the lifting assemblies 18. And, of course, the height of the cabinet assembly 12 above the floor 16 may also be adjusted, as indicated by the double-ended arrow 94 in FIG. 5, by simply raising or lowering all four of the cradles 46 by an equal amount.

After the thumb screws 72 are used in this manner to position the cabinet assembly 12 at the precise desired height on the wall 14, and to level the cabinet assembly 12 in both side-to-side and front-to-back directions, the cabinet assembly 12 is then suitably secured to the wall 14, and the lifting and leveling assemblies 18 are removed from beneath the now installed wall cabinet assembly 12 to permit the installation of base cabinets beneath the wall cabinet assembly 12 which has been lifted into place, leveled about two mutually perpendicular axes and secured to the wall by a single workman.

Figure 6:
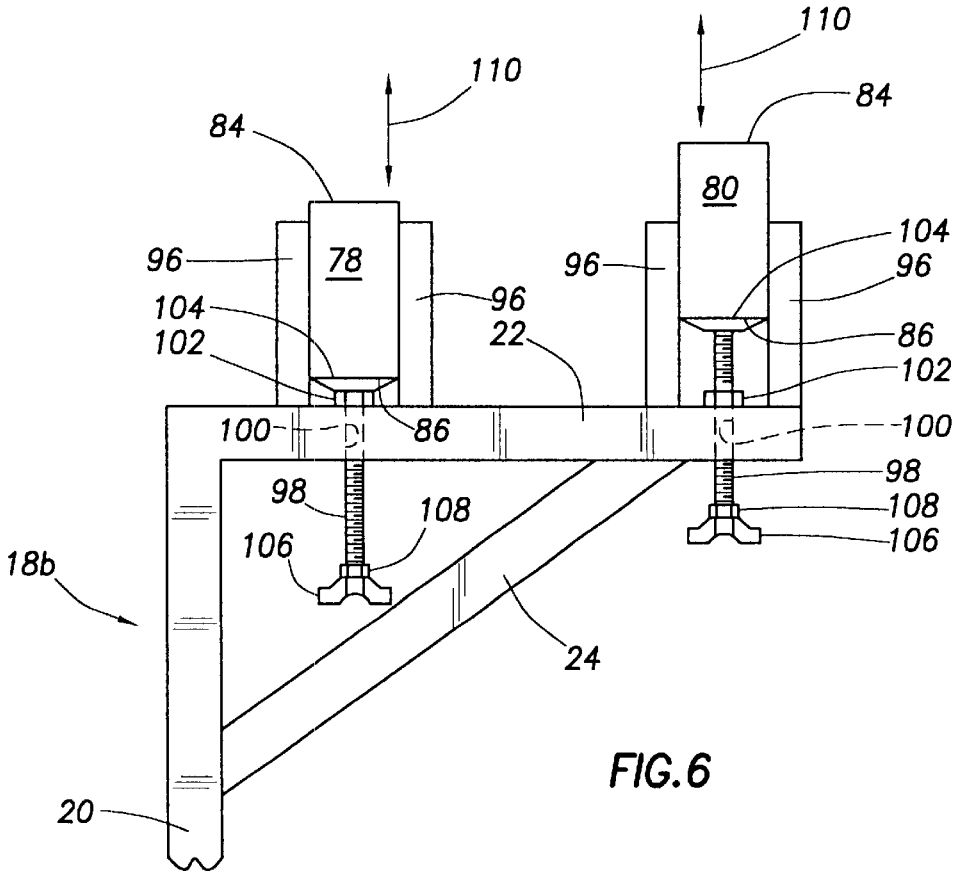
FIG. 6 is a simplified side elevational view of an alternate embodiment of an upper portion of one of the lifting and leveling assemblies.

An upper end portion of an alternate embodiment 18*b* of one of the previously described lifting and leveling assemblies 18 is shown in FIG. 6 and is operated in a manner substantially identical to that of the assemblies 18 to provide for a single workman installation of the cabinet assembly 12. The lifting and leveling assembly 18*b* is identical to each of the previously described lifting and leveling assemblies 18 except that different structures are provided on the assembly 18*b* for individually adjusting the heights of the supported studs 78 and 80 to provide for the tilting adjustment of the stud-supported cabinet structure about the two mutually perpendicular level and plumb axes 86 and 90.

Specifically, instead of previously described cradles 46 which are raisable and lowerable relative to the vertical frame section 22 to correspondingly raise and lower the studs 78 and 80, two pairs of spaced apart vertical, fixed position cradle posts 96 are anchored to the top side of the horizontal frame portion 22 in place of the previously described height-adjustable cradles 46, with the stud 78 being receivable between one of the pairs of fixed position posts 96, and the stud 80 being receivable between the other pair of fixed position posts 96 as shown in FIG. 6.

Two height adjustment bolt structures 98 extend upwardly through holes 100 in the horizontal frame portion 22, are threaded into nuts 102 welded to the top side of the horizontal frame portion 22, and have laterally enlarged upper end portions 104 that are positioned between the pairs of posts 96 and bear against the bottom side edge surfaces 86 of the studs 78,80. The lower ends of the bolt structures 98 are threaded into thumb screws 106 and are locked thereto by lock nuts 108. Rotation of the thumb screws 106 may be utilized to independently adjust the heights of the studs 78 and 80 relative to the horizontal frame section 22, and thus relative to the fixed position cradle posts 96, as indicated by the double ended arrows 110 in FIG. 6.

The foregoing detailed description is to be clearly understood as being given by way of illustration and example only, the spirit and scope of the present invention being limited solely by the appended claims.

What is claimed is:

1. For use in installing a cabinet structure on an elevated area of a wall, a lifting and leveling assembly comprising:

a base having a top portion;

spaced apart first and second receiving structures, associated with said top portion of said base, for respectively receiving portions of first and second support members upon which the cabinet structure may be rested; and first and second height adjustment structures carried by said base and being vertically movable independently of one another relative to said base to selectively and independently vary the vertical positions of the first and second support member portions relative to said base, said base having a generally inverted L-shaped frame with a vertically elongated side portion and a top end portion extending in a first direction perpendicularly to said side portion, said top end portion having a top side upon which said first and second receiving structures are disposed, and said first and second height adjustment structures being carried on said top end portion, with each of said first and second receiving structures and said first and second height adjustment structures being spaced apart from said side portion in said first direction, said vertically elongated side portion being configured and positioned relative to the balance of said assembly in a manner permitting said side portion to be placed in a vertical orientation in abutment with and anchored directly to the wall.

2. The lifting and leveling assembly of claim 1 wherein:

each of said first and second receiving structures is a spaced pair of fixed vertical projections extending upwardly from said top portion of aid base, and said first and second height adjustment structures are threaded embers secured to said top portion of said base and rotatable relative hereto in a manner causing said threaded members to extend selectively variable distances upwardly between the fixed vertical projections in said airs thereof.

3. The lifting and leveling assembly of claim 1 wherein:

said first and second receiving structures are generally U-shaped cradle structures supported atop said top portion of said base for vertical movement relative thereto, and said first and second height adjustment structures are respectively operable to selectively vary the heights of said first and second receiving structures relative to said top portion of said base.

4. The lifting and leveling assembly of claim 3 wherein:

said first and second height adjustment structures include threaded members secured to said top portion of said base and to said first and second receiving structures and being rotatable to selectively adjust the heights of said first and second receiving structures relative to said top portion of said base.

5. For use in installing a cabinet structure on an elevated area of a wall, a lifting and leveling assembly comprising:

a base having a top portion;

spaced apart first and second receiving structures, associated with said top portion of said base, for respectively receiving portions of first and second support members upon which the cabinet structure may be rested; and first and second height adjustment structures carried by said base and being vertically movable independently of one another relative to said base to selectively and independently vary the vertical positions of the first and second support member portions relative to said base, said base having a generally inverted L-shaped frame with a vertically elongated side portion and a top end portion extending in a first direction perpendicularly to said side portion, the length of said top end portion in said first direction being substantially shorter than the vertical length of said vertically elongated side portion, and said top end portion having a top side upon which said first and second receiving structures are disposed, and said first and second height adjustment structures being carried on said top end portion, with each of said first and second receiving structures and said first and second height adjustment structures being spaced apart from said side portion in said first direction, said side portion of said frame having a lower end portion, and said lifting and leveling assembly further comprising an elongated elevating member upwardly threaded into said lower end portion of said frame side portion and being rotatable relative thereto to selectively vary the distance said elevating member longitudinally projects downwardly from said lower end portion of said frame side portion.

6. The lifting and leveling assembly of claim 5 wherein:

said lifting and leveling assembly further comprises a stabilizing foot structure extending transversely outwardly from said lower end portion of said frame side portion.

7. For use in installing a cabinet structure on an elevated area of a wall, lifting and leveling apparatus comprising:

an elongated support structure upon a top side surface portion of which the cabinet structure may be rested;

first and second base structures positionable in a horizontally spaced relationship beneath the elevated wall area and having upper portions operative to hold longitudinally spaced apart portions of said elongated support structure in a manner positioning said support structure parallel to the wall and in a horizontal orientation; each of said first and second base structures having a vertically elongated side portion; and height adjustment structures associated with said upper portions of said first and second base structures for vertical movement relative thereto and being operative, when said support structure is held by said upper portions of said first and second base structures, to (1)

raise and lower said support structure, (2) tilt said support structure top side surface portion about a horizontal axis transverse to the wall, and (3) tilt said support structure top side surface portion about a horizontal axis parallel to the wall, each of said vertically elongated side portions being configured and positioned relative to the balance of its associated base structure in a manner permitting the side portion to be placed in a vertical orientation in abutment with and anchored directly to the wall.

8. The lifting and leveling apparatus of claim 7 wherein:

each of said first and second base structures has a generally inverted L-shaped frame with a top end portion extending perpendicularly to its vertically elongated side portion, said top end portion having a top side, and said height adjustment structures are carried on said top end portions.

9. The lifting and leveling apparatus of claim 7 wherein:

said elongated support structure is defined by first and second elongated support members.

10. The lifting and leveling apparatus of claim 9 wherein:

said height adjustment structures are operative to independently move said first and second elongated support members.

11. The lifting and leveling apparatus of claim 10 wherein:

each of said first and second elongated support members is a wooden stud.

12. The lifting and leveling apparatus of claim 9 wherein:

each of said upper portions of said first and second base structures includes a spaced pair of generally U-shaped, vertically movable cradle structures adapted to downwardly receive longitudinal portions of said first and second elongated support members, and said height adjustment structures are operative to selectively adjust the heights of said cradle structures relative to their associated base structure upper portion.

13. The lifting and leveling apparatus of claim 9 wherein:

each of said upper portions of said first and second base structures includes first and second spaced pairs of fixed position, upwardly extending projections, each projection pair being adapted to downwardly receive therebetween a longitudinal portion of one of said first and second elongated support members, and said height adjustment structures are movable upwardly and downwardly between each projection pair.

14. For use in installing a cabinet structure on an elevated area of a wall, lifting and leveling apparatus comprising:

an elongated support structure upon a top side surface portion of which the cabinet structure may be rested;

first and second base structures positionable in a horizontally spaced relationship beneath the elevated wall area and having upper portions operative to hold longitudinally spaced apart portions of said elongated support structure in a manner positioning said support structure parallel to the wall and in a horizontal orientation; and height adjustment structures associated with said upper portions of said first and second base structures for vertical movement relative thereto and being operative, when said support structure is held by said upper portions of said first and second base structures, to (1) raise and lower said support structure, (2) tilt said support structure top side surface portion about a horizontal axis transverse to the wall, and (3) tilt said support structure top side surface portion about a horizontal axis parallel to the wall, each of said first and second base structures having a generally inverted L-shaped frame with a vertically orientable side portion and a top end portion extending perpendicularly to said side portion, said top end portion having a top side, and said height adjustment structures being carried on said top end portions, each frame side portion having a lower end portion into which an elongated elevating member is upwardly threaded, said elevating member being rotatable relative to its associated frame side portion to selectively vary the distance said elevating member longitudinally projects downwardly from its associated lower end portion.

15. The lifting and leveling apparatus of claim 14 wherein:

each of said frames has a stabilizing foot structure extending transversely outwardly from said lower end portion of the side portion of the frame.

16. A method of installing a cabinet structure on an elevated area of a wall, said method comprising the steps of:

providing an elongated support structure having a top side surface portion;

resting said elongated support structure in a generally horizontal orientation, and parallel to the wall with said top side surface portion facing upwardly, on first and second horizontally spaced apart lifting and leveling assemblies having height adjustment apparatus operative to selectively (1) vary the height of said support structure, (2) tilt said top side surface portion of said support structure about a first horizontal axis transverse to the wall, and (3) tilt said top side surface portion of said support structure about a second horizontal axis parallel to the wall;

anchoring vertical side portions of said lifting and leveling assemblies to the wall;

positioning the cabinet structure atop said top side surface portion of said support structure and adjacent the elevated wall area;

using said height adjustment apparatus to level the cabinet structure about said first and second horizontal axes; and securing the leveled cabinet structure to the elevated area of the wall.

17. The method of claim 16 wherein:

said positioning step includes the steps of positioning a plurality of cabinet modules atop said top side surface portion of said support structure and then intersecuring said plurality of cabinet modules to form said cabinet structure.

18. The method of claim 16 wherein:

said providing step is performed by providing first and second elongated support members, said resting step is performed by resting said first and second elongated support members in a parallel, horizontally spaced apart horizontal orientation on said first and second horizontally spaced apart lifting and leveling assemblies, and said using step is performed by utilizing said height adjustment apparatus to vertically move one of said first and second elongated support members relative to the other of said first and second elongated support members.

19. The method of claim 18 wherein:

said providing step is performed by providing first and second wooden stud members.

* * * * *